US008269593B2

(12) United States Patent
Tsai et al.

(10) Patent No.: US 8,269,593 B2
(45) Date of Patent: Sep. 18, 2012

(54) MAGNETIC ELEMENT AND BOBBIN THEREOF

(75) Inventors: Hsin-Wei Tsai, Taoyuan Hsien (TW); Chun-Ping Chen, Taoyuan Hsien (TW); Ti-Chin Chen, Taoyuan Hsien (TW); Hsiang-Yi Tseng, Taoyuan Hsien (TW); Bou-Jun Zung, Taoyuan Hsien (TW); Ming-Cheng Li, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 10 days.

(21) Appl. No.: 13/018,008

(22) Filed: Jan. 31, 2011

(65) Prior Publication Data

US 2011/0193673 A1 Aug. 11, 2011

(30) Foreign Application Priority Data

Feb. 6, 2010 (TW) ..... 99103691 A

(51) Int. Cl.
*H01F 27/30* (2006.01)
*H01F 27/29* (2006.01)
*H01F 5/00* (2006.01)

(52) U.S. Cl. ..... 336/198; 336/192; 336/196; 336/200; 336/208

(58) Field of Classification Search ..... 336/192, 336/198, 208
See application file for complete search history.

(56) References Cited

U.S. PATENT DOCUMENTS 7,061,358 B1 * 6/2006 Yang ..... 336/198
2007/0126542 A1 * 6/2007 He et al. ..... 336/83
* cited by examiner

*Primary Examiner* — Mohamad Musleh
*Assistant Examiner* — Ronald Hinson
(74) *Attorney, Agent, or Firm* — Kirton McConkie; Evan R. Witt

(57) ABSTRACT

A magnetic element includes a bobbin, a first winding assembly, a second winding assembly and a magnetic core assembly. The bobbin includes a winding part, a first extension part and a second extension part. The first extension part and the second extension part are separated from each other by the winding part. The first winding assembly is wound around the winding part of the bobbin, and includes plural first terminals. The second winding assembly is wound around the winding part of the bobbin, and includes plural second terminals. The magnetic core assembly includes a first window and a second window. The first extension part is protruded out of the first window. The second extension part is protruded out of the second window. At least one of the first terminals and at least one of the second terminals are simultaneously fixed on the first extension part and/or the second extension part.

11 Claims, 6 Drawing Sheets

MAGNETIC ELEMENT AND BOBBIN THEREOF

FIELD OF THE INVENTION

The present invention relates to a bobbin of a magnetic element, and more particularly to a bobbin of a magnetic element for distributing the terminals of the winding assembly.

BACKGROUND OF THE INVENTION

Magnetic elements such as inductors and transformers are widely used in power supply apparatuses or many electronic devices to generate induced magnetic fluxes. Nowadays, the electronic device is developed to have small size, high power, diversified function and popularity. As such, the magnetic element needs to have slim and diversified appearance, enhanced performance and cost-effectiveness.

FIG. 1 is a schematic side view illustrating a conventional magnetic element. As shown in FIG. 1, the magnetic element 1 (e.g. a transformer) has a first winding assembly 11 and a second winding assembly 12. The first winding assembly 11 and the second winding assembly 12 are wound around a bobbin 10. For meeting safety regulations, plural first terminals 111 of the first winding assembly 11 and plural second terminals 121 of the second winding assembly 12 are respectively wound around plural first pins 101 and plural second pins 102, which are disposed at bilateral sides of the bobbin 10. That is, the first winding assembly 11 and the second winding assembly 12 are placed on two opposite sides of the bobbin 10 to maintain safety distance. The first winding assembly 11, the second winding assembly 12, the bobbin 10 and the magnetic core assembly 13 are combined together to produce the magnetic element 1. Moreover, the magnetic core assembly 13 has a first window 131 and a second window 132 for accommodating the first terminals 111 of the first winding assembly 11 and the second terminals 121 of the second winding assembly 12, respectively.

Since the current flowing through the second winding assembly 12 is relatively higher, the second winding assembly 12 includes thicker conducting wires in order to avoid an overheating condition. Generally, too many thicker second terminals 121 of the second winding assembly 12 become hindrance from assembling the magnetic core assembly 13 with the bobbin 10. In addition, since the first terminals 111 and the second terminals 121 are respectively accommodated within the first window 131 and the second window 132, the numbers of the first terminals 111 and the second terminals 121 need to be properly controlled according to the dimensions of the first window 131 and the second window 132. For example, if the second winding assembly 12 has too many second terminals 121, the manufacturer may increase the dimension of the second window 132 or adjust the diameter or turn number of the second winding assembly 12. As known, the process of changing the specification of the magnetic core assembly 13 or the magnetic element 1 is time-consuming and labor-intensive. For avoiding crowded second terminals 121 in the second window 132, several magnetic elements 1 are employed to distribute the second terminals of the second winding assembly 12. Too many magnetic elements 1 occupies much layout space of the circuit board and increases the overall fabricating cost.

There is a need of providing a magnetic element and a bobbin thereof to obviate the drawbacks encountered from the prior art.

SUMMARY OF THE INVENTION

It is an object of the present invention to provide a bobbin of a magnetic element for distributing the terminals of the winding assembly while meeting the safety regulations.

Another object of the present invention provides a bobbin of a magnetic element, in which the window utilization of the magnetic core assembly is enhanced and the terminals are no longer crowded in the window of the magnetic core assembly.

A further object of the present invention provides magnetic element having such a bobbin in order to enhance the heat-dissipating efficacy.

In accordance with an aspect of the present invention, there is provided a bobbin of a magnetic element. The magnetic element includes a first winding assembly and a second winding assembly. The first winding assembly includes plural first terminals. The second winding assembly includes plural second terminals. The bobbin includes a winding part, a first extension part and a second extension part. The second extension part is separated from the first extension part by the winding part. At least one of the first terminals and at least one of the second terminals are simultaneously fixed on at least one of the first extension part and the second extension part.

In accordance with another aspect of the present invention, there is provided a magnetic element. The magnetic element includes a bobbin, a first winding assembly, a second winding assembly and a magnetic core assembly. The bobbin includes a winding part, a first extension part and a second extension part. The first extension part and the second extension part are separated from each other by the winding part. The first winding assembly is wound around the winding part of the bobbin, and includes plural first terminals. The second winding assembly is wound around the winding part of the bobbin, and includes plural second terminals. The magnetic core assembly shields the winding part of the bobbin, the first winding assembly and the second winding assembly. The magnetic core assembly includes a first window and a second window. The first extension part is protruded out of the first window. The second extension part is protruded out of the second window. At least one of the first terminals and at least one of the second terminals are simultaneously fixed on at least one of the first extension part and the second extension part.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
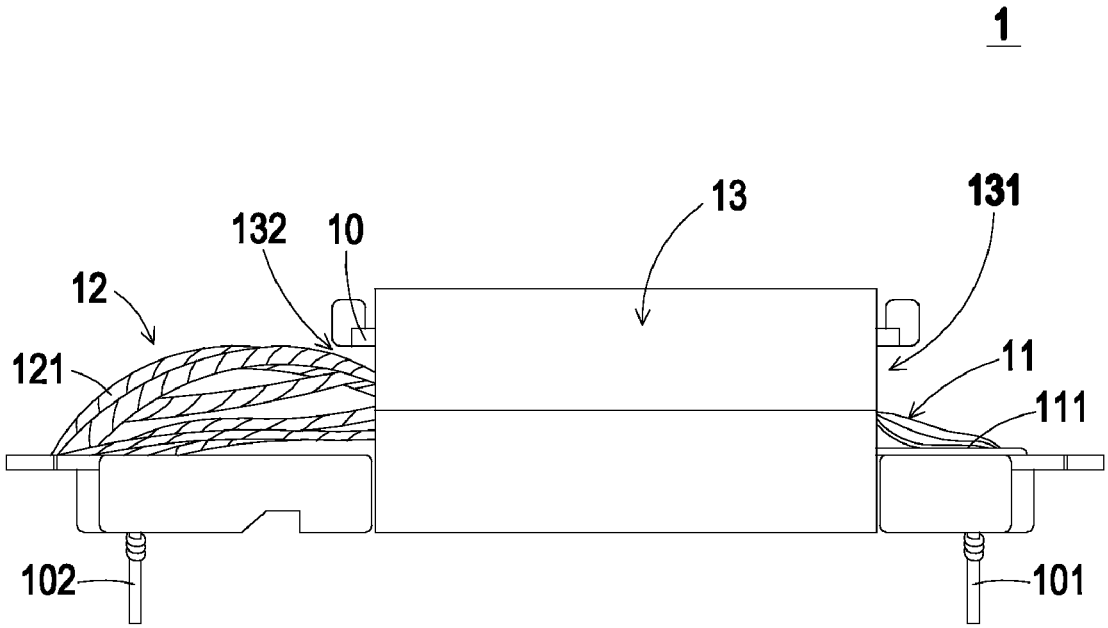
FIG. 1 PRIOR ART
FIG. 1 is a schematic side view illustrating a conventional magnetic element.
Figure 2A:
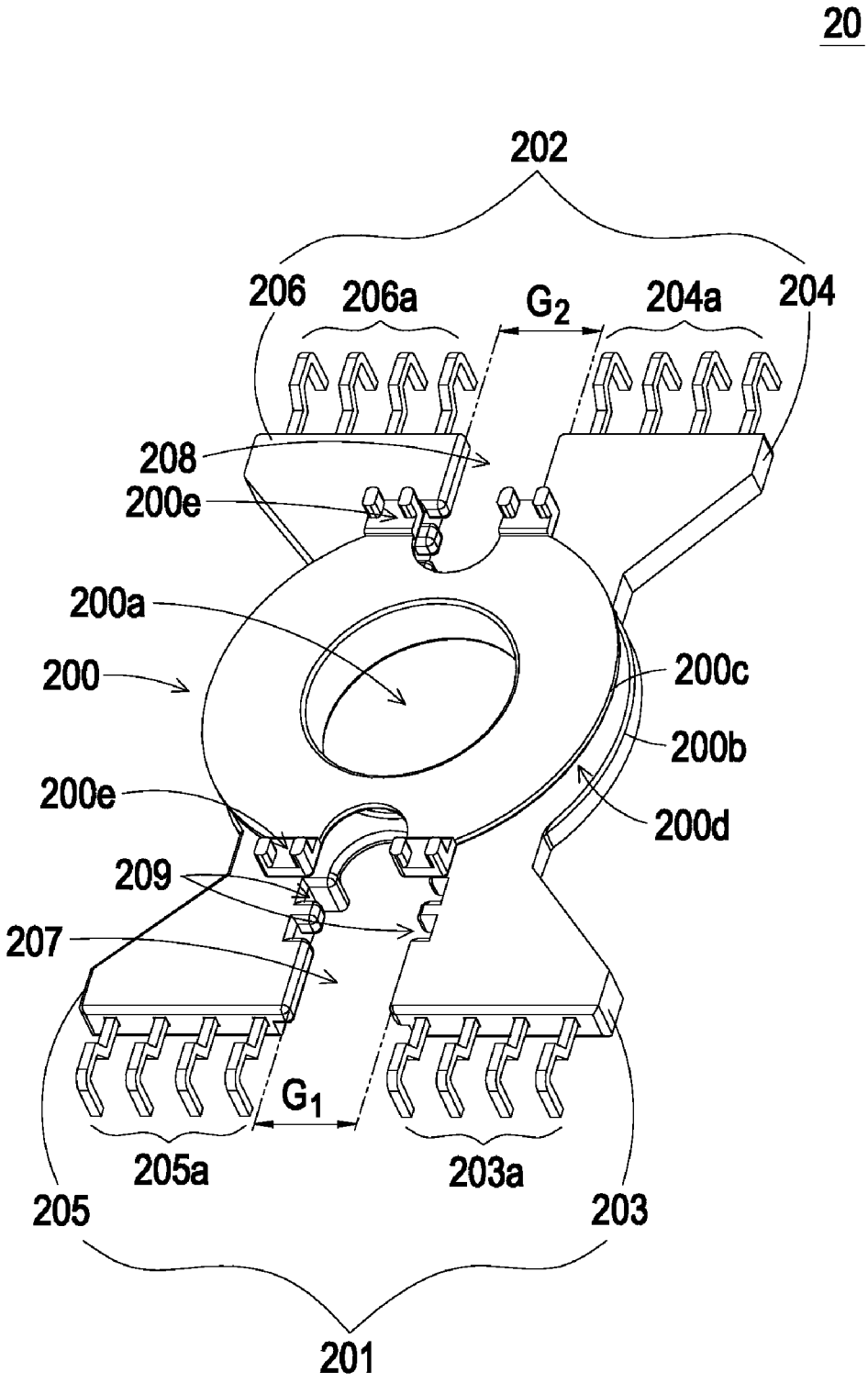
FIG. 2A is a schematic perspective view illustrating a bobbin according to a first embodiment of the present invention.
Figure 2B:
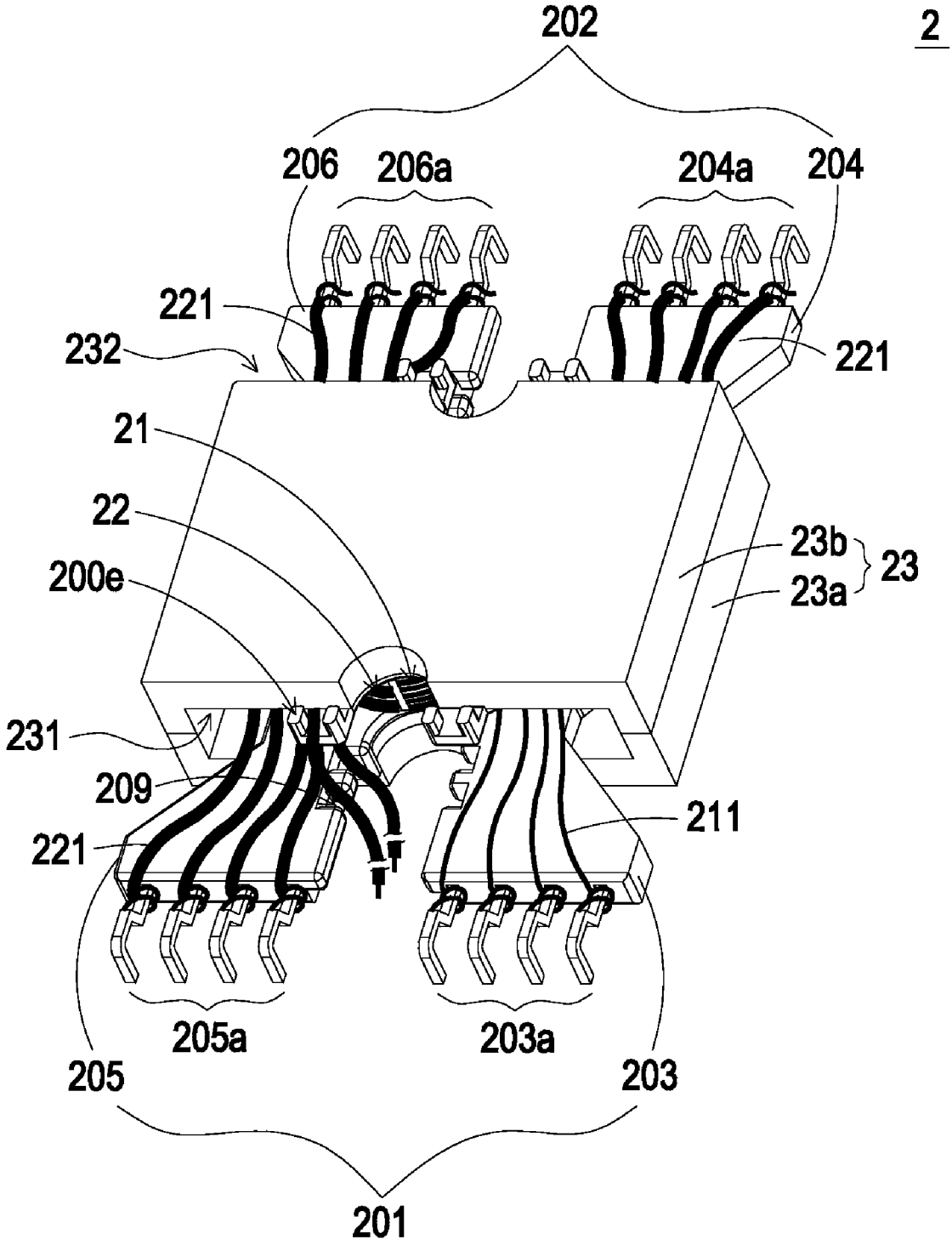
FIG. 2B is a schematic perspective view illustrating a magnetic element having the bobbin of FIG. 2A.

FIG. 2A is a schematic perspective view illustrating a bobbin according to a first embodiment of the present invention. FIG. 2B is a schematic perspective view illustrating a magnetic element having the bobbin of FIG. 2A. In this embodiment, the bobbin 20 is applied to a magnetic element 2 (e.g. a transformer). As shown in FIGS. 2A and 2B, the magnetic element 2 comprises a first winding assembly 21 and a second winding assembly 22. The first winding assembly 21 comprises plural first terminals 211. The second winding assembly 22 comprises plural second terminals 221. The bobbin 20 comprises a winding part 200, a first extension part 201 and a second extension part 202. The first extension part 201 and the second extension part 202 are separated from each other by the winding part 200. At least one of the first terminals 211 and at least one of the second terminals 221 are simultaneously fixed on at least one of the first extension part 201 and the second extension part 202.

Please refer to FIG. 2A again. The first extension part 201 of the bobbin 20 is extended from a first side of the winding part 200. The first extension part 201 comprises a first base 203 and a second base 205. The first base 203 and the second base 205 are separated from each other by a first gap 207 with a width G1. In this embodiment, the first base 203 and the second base 205 have the identical profile. For example, the first base 203 and the second base 205 are trapezoid bases, which are externally widened from the winding part 200. Preferably, the first base 203 and the second base 205 are symmetrical with respect to the first gap 207. In addition, plural first pins 203*a* are extended from the edge side of the first base 203. The first pins 203*a* are made of conductive material (e.g. metallic material). A first end of the first pin 203*a* is buried within the first base 203. A second end of the first pin 203*a* is bent as a hook, so that the distal end of the first pin 203*a* is substantially perpendicular to the first base 203. In addition, plural second pins 205*a* made of conductive material are extended from the edge side of the second base 205. The arrangements of the second pins 205*a* with respect to the second base 205 are similar to those of the first pins 203*a* with respect to the first base 203, and are not redundantly described herein. The numbers of the first pins 203*a* and the second pins 205*a* are varied according to the practical requirements of the magnetic element 2. Through the first pins 203*a* and the second pins 205*a*, the first extension part 201 of the bobbin 20 is electrically connected to a circuit board (not shown). The first pins 203*a* and the second pins 205*a* are separated from each other by the first gap 207.

The second extension part 202 is extended from a second side of the winding part 200, wherein the second side is opposed to the first side. That is, the first extension part 201 and the second extension part 202 are separated from each other by the winding part 200. The second extension part 202 comprises a third base 204 and a fourth base 206. The third base 204 and the fourth base 206 are separated from each other by a second gap 208 with a width G2. In this embodiment, the third base 204 and the fourth base 206 have the identical profile. In addition, the profiles of the third base 204 and the fourth base 206 may be identical to those of the first base 203 and the second base 205. The third base 204 and the fourth base 206 are trapezoid bases, which are externally widened from the winding part 200. Preferably, the third base 204 and the fourth base 206 are symmetrical with respect to the second gap 208. In addition, plural third pins 204*a* are extended from the edge side of the third base 204, and plural fourth pins 205*a* are extended from the edge side of the fourth base 206. The arrangements of the third pins 204*a* with respect to the third base 204 and the fourth pins 206*a* with respect to the fourth base 206 are similar to those of the first pins 203*a* with respect to the first base 203 and the second pins 205*a* with respect to the second base 205, and are not redundantly described herein. Through the third pins 204*a* and the fourth pins 206*a*, the second extension part 202 of the bobbin 20 is electrically connected to the circuit board (not shown). The third pins 204*a* and the fourth pins 206*a* are separated from each other by the second gap 208.

Please refer to FIG. 2A again. The winding part 200 of the bobbin 20 comprises a channel 200*a*, a first lateral plate 200*b* and a second lateral plate 200*c*. The first lateral plate 200*b* and the second lateral plate 200*c* are opposed to each other, so that a wire-winding region 200*d* is defined between the first lateral plate 200*b* and the second lateral plate 200*c*. The channel 200*a* runs through the first lateral plate 200*b* and the second lateral plate 200*c* in the axial direction. In this embodiment, the first base 203 and the second base 205 of the first extension part 201 and the third base 204 and the four base 206 of the second extension part 202 are extended from the first lateral plate 200*b* of the winding part 200. It is preferred that the first base 203, the second base 205, the third base 204 and the four base 206 are integrally formed with the first lateral plate 200*b*. The first sides of the first base 203, the second base 205, the third base 204 and the four base 206 are coplanar with the surface of the first lateral plate 200*b* that faces the wire-winding region 200*d*. In addition, the second sides of the first base 203, the second base 205, the third base 204 and the four base 206 are protruded from the surface of the first lateral plate 200*b* that is distant from the wire-winding region 200*d*. As such, the first base 203, the second base 205, the third base 204 and the four base 206 could facilitate positioning the magnetic core assembly 23 (see FIG. 2B). Moreover, several (e.g. four) wire-arranging notches 200*e* are formed in the second lateral plate 200*c* for guiding the first terminals 211 of the first winding assembly 21 and/or the second terminals 221 of the second winding assembly 22. In this embodiment, the wire-arranging notches 200*e* are horizontally extended from the periphery of the second lateral plate 200*c*. The four wire-arranging notches 200*e* are respectively disposed on the first base 203, the second base 205, the third base 204 and the four base 206. The wire-arranging notches 200*e* are slightly protruded from the surface of the second lateral plate 200*c* that is distant from the wire-winding region 200*d* for further facilitating positioning the magnetic core assembly 23 (see FIG. 2B). The bobbin 20 further comprises plural guiding notches 209. In this embodiment, the guiding notches 209 are formed in the first base 203 and the second base 205 in the vicinity of the first gap 207 and the third base 204 and the four base 206 in the vicinity of the second gap 208. Some of the first terminals 211 and/or the second terminals 221 are guided by the guiding notches 209 to be fixed on the circuit board (not shown). It is preferred that all components of the bobbin 20 are integrally formed and produced by a plastic injection molding process.

Please refer to FIGS. 2A and 2B again. The first winding assembly 21 and the second winding assembly 22 are conductive wires wound around the wire-winding region 200*d* of the winding part 200. The first winding assembly 21 and the second winding assembly 22 may be covered with insulating material such as an insulating tape. For brevity, the insulating tape is not shown on FIG. 2B. The first winding assembly 21 comprises plural first terminals 211. The second winding assembly 22 comprises plural second terminals 221. In a case that the current flowing through the second winding assembly 22 is relatively higher, the second winding assembly 22 includes thicker conducting wires. For distributing the second terminals 221 of the second winding assembly 22, the relatively thinner first terminals 211 of the first winding assembly 21 are placed on the first base 203 of the first extension part 201 and electrically connected with the first pins 203*a*. Whereas, the relatively thicker second terminals 221 of the second winding assembly 22 are placed on the second base 205 of the first extension part 201 and the third base 204 and the fourth base 206 of the second extension part 202, and electrically connected with the second pins 205*a*, the third pins 204*a* and the fourth pins 206*a*, respectively. In this embodiment, the first winding assembly 21 comprises two conductive wires. The beginning terminals of these two conductive wires are wound around two of the first pins 203*a*, placed on the first base 203, and then wound around the wire-winding region 200*d* of the winding part 200 for predetermined turns. Then, the ending terminals of these two conductive wires are placed on the first base 203 and wound around the other two of the first pins 203*a*. Afterwards, solder paste (not shown) is applied on the first terminals 211, so that the first terminals 211 are securely fixed on and electrically connected with the first pins 203*a*. The conductive wires of the second winding assembly 22 are also wound around the wire-winding region 200*d*. The second terminals 221 are fixed on and electrically connected with the second pins 205*a*, the third pins 204*a* and the fourth pins 206*a*. Optionally, some of the second terminals 221 could be supported by the wire-arranging notches 200*e*, and guided by the guiding notches 209 to be directly connected with the circuit board (not shown). For example, as shown in FIG. 2B, the second terminals are guided by the guiding notches 209 that are formed in the second base 205.

The magnetic core assembly 23 has a profile mating with the bobbin 20. The magnetic core assembly 23 comprises a first magnetic core 23*a* and a second magnetic core 23*b*. The first magnetic core 23*a* is disposed on the first lateral plate 200*b* of the winding part 200. The second sides of the first base 203, the second base 205, the third base 204 and the four base 206 are slightly protruded from the surface of the first lateral plate 200*b* for facilitating positioning the first magnetic core 23*a* with respect to the first lateral plate 200*b*. The second magnetic core 23*b* is disposed on the second lateral plate 200*c* of the winding part 200. The wire-arranging notches 200*e* are slightly protruded from the surface of the second lateral plate 200*c* for facilitating positioning the second magnetic core 23*b* with respect to the second lateral plate 200*c*. Meanwhile, the winding part 200 with the first winding assembly 21 and the second winding assembly 22 are sandwiched between the first magnetic core 23*a* and the second magnetic core 23*b*. The resulting structure of the magnetic element 2 is shown in FIG. 2B.

After the first magnetic core 23*a*, the second magnetic core 23*b* and the bobbin 20 are combined together, a first window 231 and a second window 232 are defined. In this embodiment, the first window 231 and the second window 232 have the same area. The first window 231 is formed in the same side of the first extension part 201 of the bobbin 20. That is, the first base 203 and the second base 205 of the first extension part 201 are protruded out of the first window 231. The second window 232 is formed in the same side of the second extension part 202 of the bobbin 20. That is, the third base 204 and the fourth base 206 of the second extension part 202 are protruded out of the second window 232. In this embodiment, the first terminals 211 are disposed on the first base 203 of the first extension part 201, and some of the second terminals 221 of the second winding assembly 22 are disposed on the second base 205 of the first extension part 201. In other words, the first terminals 211 and some of the second terminals 221 are simultaneously fixed on the first extension part 201. In addition, the first terminals 211 and some of the second terminals 221 are simultaneously accommodated within the first window 231. The first pins 203*a* extended from the first base 203 and the second pins 205*a* extended from the second base 205 are separated from each other by a spacing interval, which is at least greater than the width G1 of the first gap 207. As such, a safety distance is maintained between the first terminals 211 and the second terminals 221 due to the first gap 207. In this situation, the magnetic element 2 can meet the safety regulations.

In this embodiment, the second winding assembly 22 includes thicker conducting wires. For distributing the second terminals 221 of the second winding assembly 22, the second terminals 221 are placed on the second base 205 of the first extension part 201 and the third base 204 and the fourth base 206 of the second extension part 202. Whereas, the first terminals 211 of the first winding assembly 21 are placed on the first base 203. Since the relative thicker second terminals 221 are distributed, the second terminals 221 are no longer crowded in the second window 132. In this situation, the magnetic core assembly 23 could be properly assembled with the bobbin 20, and the heat could be effectively dissipated. Moreover, due to the first gap 207, the safety distance of the magnetic element 2 is increased. The width G1 of the first gap 207 may be adjusted according to the voltage difference between the first winding assembly 21 and the second winding assembly 22, so that the magnetic element 2 can meet the safety regulations.

Figure 3:
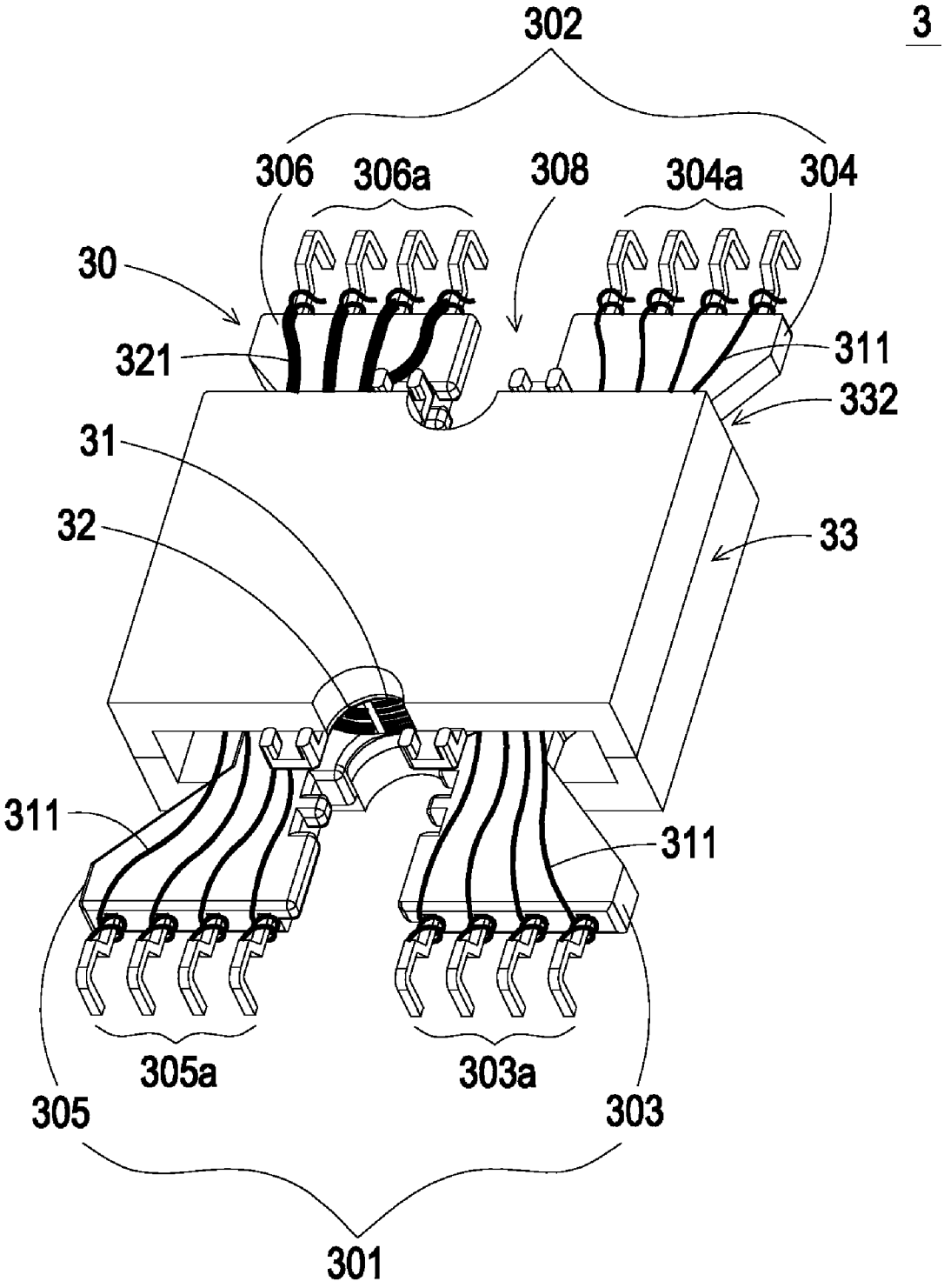
FIG. 3 is a schematic perspective view illustrating another exemplary magnetic element having the bobbin of FIG. 2A.

FIG. 3 is a schematic perspective view illustrating another exemplary magnetic element having the bobbin of FIG. 2A. The bobbin 30 and the magnetic core assembly 33 included in the magnetic element 3 are similar to those shown in FIG. 2B, and are not redundantly described herein. The first winding assembly 31 comprises plural first terminals 311. The second winding assembly 32 comprises plural second terminals 321. The number of the first terminals 311 is greater than the number of the second terminals 321. For distributing the first terminals 311 of the first winding assembly 31, the first terminals 311 are fixed on the first base 303 and the second base 305 of the first extension part 301 and third base 304 of the second extension part 302, and electrically connected with the first pins 303*a*, the second pins 305*a* and the third pins 304*a*, respectively. Since the number of the second terminals 321 is smaller than the number of the first terminals 311, the second terminals 321 is fixed on the fourth base 306 of the second extension part 302 and electrically connected with the fourth pins 306*a*. In other words, some of the first terminals 311 and the second terminals 321 are simultaneously fixed on the second extension part 302. In addition, some of the first terminals 311 and the second terminals 321 are simultaneously accommodated within the second window 332 of the magnetic core assembly 33. The third pins 304*a* extended from the third base 304 and the fourth pins 306*a* extended from the fourth base 306 are separated from each other by a spacing interval, which is at least greater than the width of the second gap 308. As such, a safety distance is maintained between the first terminals 311 and the second terminals 321 due to the second gap 308. In this situation, the magnetic element 3 can meet the safety regulations.

Figure 4A:
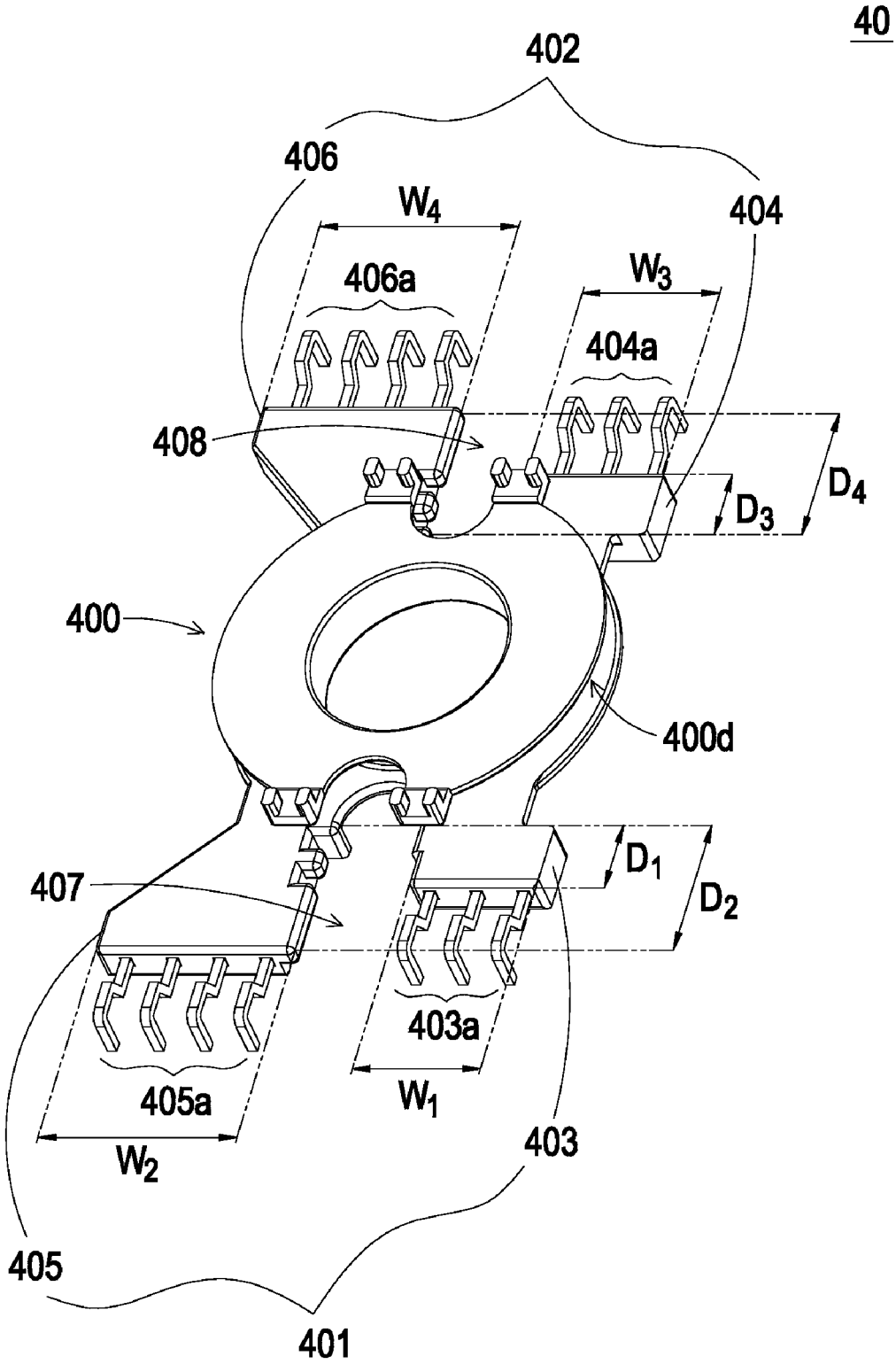
FIG. 4A is a schematic perspective view illustrating a bobbin according to a second embodiment of the present invention.
Figure 4B:
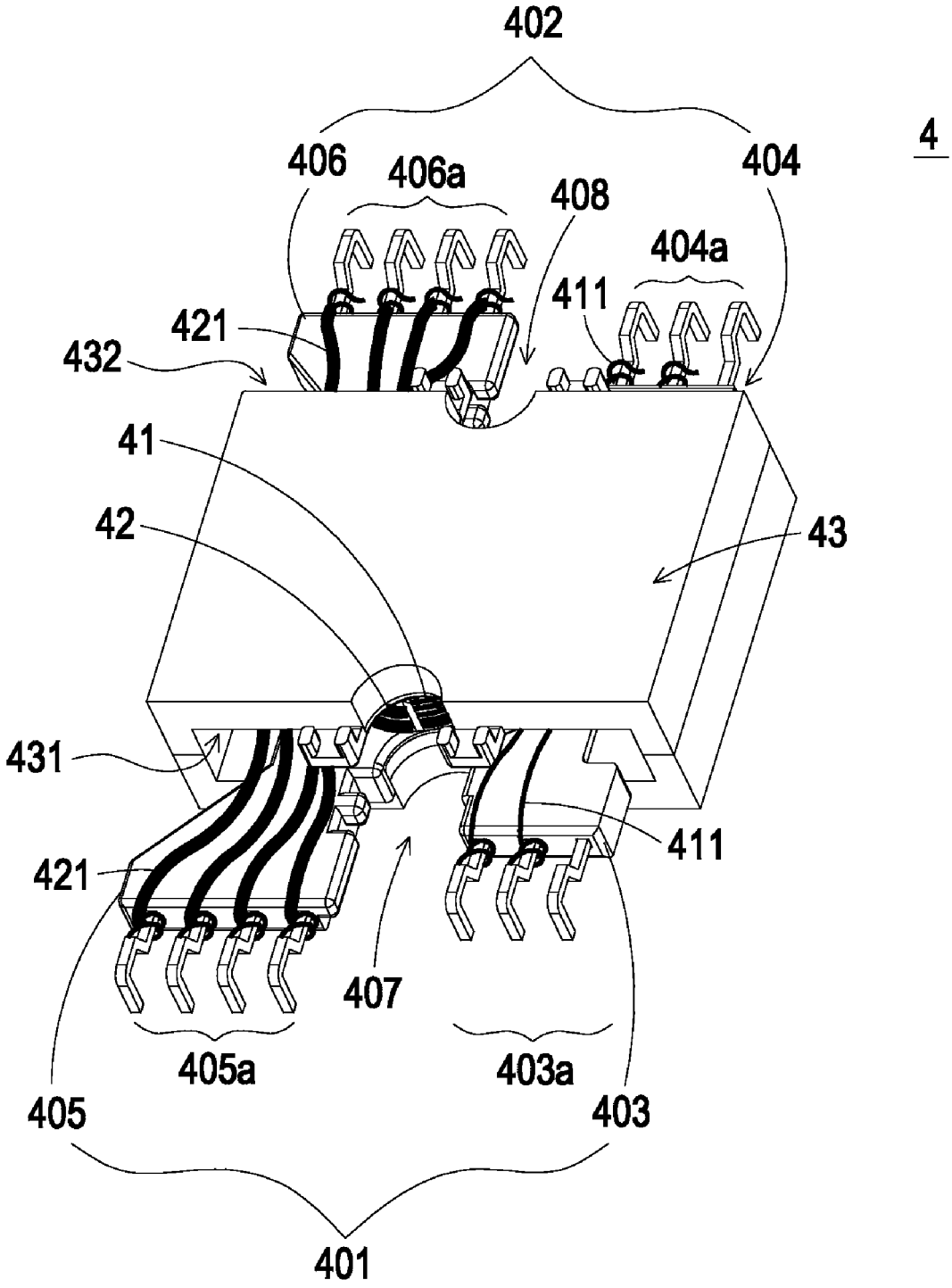
FIG. 4B is a schematic perspective view illustrating a magnetic element having the bobbin of FIG. 4A.

FIG. 4A is a schematic perspective view illustrating a bobbin according to a second embodiment of the present invention. FIG. 4B is a schematic perspective view illustrating a magnetic element having the bobbin of FIG. 4A. As shown in FIGS. 4A and 4B, the magnetic element 4 comprises a bobbin 40, a first winding assembly 41, a second winding assembly 42 and a magnetic core assembly 43. The bobbin 40 comprises a winding part 400, a first extension part 401 and a second extension part 402. The first extension part 401 and the second extension part 402 are separated from each other by the winding part 400. The first extension part 401 comprises a first base 403 and a second base 405. The second extension part 402 comprises a third base 404 and a fourth base 406. The first base 403 and the second base 405 are separated from each other by a first gap 407. The third base 404 and the fourth base 406 are separated from each other by a second gap 408. The first base 403 is substantially a rectangular base. The distance D1 between the first pins 403*a* and the winding part 400 is shorter than the distance D2 between the second pins 405*a* and the winding part 400. The first pins 403*a* are extended from an edge side of the first base 403, which has a width W1. The second pins 405*a* are extended from an edge side of the second base 405, which has a width W2. The width W1 is shorter than the width W2. In other words, the second base 405 is protruded more externally than the first base 403.

Please refer to FIG. 4A again. The third base 404 is substantially a rectangular base. The profile of the third base 404 is identical to the first base 403. The distance D3 between the third pins 404*a* and the winding part 400 is shorter than the distance D4 between the fourth pins 406*a* and the winding part 400. The third pins 404*a* are extended from an edge side of the third base 404, which has a width W3. The fourth pins 406*a* are extended from an edge side of the fourth base 406, which has a width W4. The width W3 is shorter than the width W4. In other words, the fourth base 406 is protruded more externally than the third base 404.

Please refer to FIGS. 4A and 4*b* again. The first winding assembly 41 and the second winding assembly 42 are wound around the wire-winding region 400*d* of the winding part 400. The first winding assembly 41 comprises plural first terminals 411. The second winding assembly 42 comprises plural second terminals 412. In this embodiment, the voltage across the second winding assembly 42 is higher than the voltage across the first winding assembly 41. The second terminals 412 of the second winding assembly 42 are placed on the second base 405 of the first extension part 401 and the fourth base 406 of the second extension part 402, and electrically connected with the second pins 405*a* and the fourth pins 406*a*, respectively. The first terminals 411 of the first winding assembly 41 are placed on the first base 403 of the first extension part 401 and the third base 405 of the second extension part 402, and electrically connected with the first pins 403*a* and the third pins 404*a*, respectively. Since the distance D2 between the second pins 405*a* and the winding part 400 is longer than the distance D1 between the first pins 403*a* and the winding part 400 and the distance D4 between the fourth pins 406*a* and the winding part 400 is longer than the distance D3 between the third pins 404*a* and the winding part 400, the safety distance is extended. After the bobbin 40, the first winding assembly 41 and the second winding assembly 42 are combined together, the resulting structure of the magnetic element 4 is shown in FIG. 4B.

The magnetic core assembly 43 comprises a first window 431 and a second window 432. The first window 431 is formed in the same side of the first extension part 401 of the bobbin 40. That is, the first base 403 and the second base 405 of the first extension part 401 are protruded out of the first window 431. The second window 432 is formed in the same side of the second extension part 402 of the bobbin 40. That is, the third base 404 and the fourth base 406 of the second extension part 402 are protruded out of the second window 432. In this embodiment, some of the first terminals 411 and some of the second terminals 421 are simultaneously fixed on the first extension part 401, and some of the first terminals 411 and some of the second terminals 421 are simultaneously fixed on the second extension part 402. As such, some of the first terminals 411 and some of the second terminals 421 are accommodated within the first window 431, and some of the first terminals 411 and some of the second terminals 421 are accommodated within the second window 432. The first base 403 and the second base 405 of the first extension part 401 are separated from each other by a first gap 407. The second base 402 and the fourth base 406 of the second extension part 402 are separated from each other by a second gap 408. As such, a safety distance is maintained between the first terminals 411 and the second terminals 421 due to the first gap 407 and the second gap 408. In this situation, the magnetic element 4 can meet the safety regulations.

Since the voltage across the first winding assembly 41 is lower than the voltage across the second winding assembly 42, the first base 403 and the third base 404 could be shorter than the second base 405 and the fourth base 406. In this situation, the fabricating cost of the bobbin 40 is reduced.

On the other hand, in a case that the voltage across the second winding assembly 42 is lower than the voltage across the first winding assembly 41, the first terminals of the first winding assembly 41 are placed on the second base 405 of the first extension part 401 and the fourth base 406 of the second extension part 402. In addition, the second terminals of the second winding assembly 42 are placed on the first base 403 and the third base 404. As such, the magnetic element 4 can meet the safety regulations.

The bobbins as shown in FIGS. 2B and 3 may be modified according to the voltage across the winding assembly. For example, the terminals of the winding assembly having a lower voltage may be placed on smaller bases in order to save the fabricating cost. In the bobbin of FIGS. 2A and 4A, the first base (or the first pins) and the second base (or the second pins) are separated from each other by the first gap, and the third base (or the third pins) and the fourth base (or the fourth pins) are separated from each other by the second gap. In a case that there is a sufficient safety distance between the first pin and the adjacent second pin or between the third pin and the adjacent fourth pin, the first extension part or the second extension part may have a single base.

From the above description, the bobbin of the present invention is capable of distributing the first terminals of the first winding assembly and/or the second terminals of the second winding assembly. As such, the first terminals or the second terminals are no longer crowded in the first window or the second window. Even if the window area is constant, the window utilization of the magnetic core assembly is enhanced because the first terminals and/or the second terminals are effectively distributed. Since the magnetic core assembly is no longer replaced with a new one or re-designed, the process of assembling the magnetic element is more time-saving and cost-effective.

Moreover, since the first terminals and/or the second terminals are effectively distributed, the first terminals and/or the second terminals will no longer become hindrance from assembling the magnetic core assembly with the bobbin. Moreover, the heat generated by the magnetic element will be dissipated to avoid the overheating condition. The diameter of the conductive wires of the first winding assembly and the second winding assembly and the number of the terminals may be varied according to the practical requirements. In addition, the dimension of the base of the bobbin may be adjusted according to the voltages across the first winding assembly and the second winding assembly. As a consequence, the magnetic element can meet the safety regulation while saving the fabricating cost.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A bobbin of a magnetic element, said magnetic element comprising a first winding assembly and a second winding assembly, said first winding assembly comprising plural first terminals, said second winding assembly comprising plural second terminals, said bobbin comprising:

a winding part;

a first extension part comprising a first base and a second base, wherein plural first pins are extended from said first base and plural second pins are extended from said second base; and a second extension part separated from said first extension part by said winding part and comprising a third base and a fourth base, wherein plural third pins are extended from said third base and plural fourth pins are extended from said fourth base, wherein at least one of said first terminals and at least one of said second terminals are simultaneously fixed on at least one of said first extension part and said second extension part, said first terminals of said first winding assembly are placed on said first base of said first extension part and said third base of said second extension part and electrically connected with said first pins and said third pins, respectively, and said second terminals of said second winding assembly are placed on said second base of said first extension part and said fourth base of said second extension part and electrically connected with said second pins and said fourth pins, respectively.

2. The bobbin according to claim 1 wherein said first base and said second base of said first extension part are separated from each other by a first gap, and said third base and said fourth base of said second extension part are separated from each other by a second gap.

3. The bobbin according to claim 1 wherein the voltage across said second winding assembly is higher than the voltage across said first winding assembly.

4. The bobbin according to claim 3 wherein a first distance between said first pins and said winding part is shorter than a second distance between said second pins and said winding part, a first width of said first base is shorter than a second width of said second base, a third distance between said third pins and said winding part is shorter than a fourth distance between said fourth pins and said winding part, and a third width of said third base is shorter than a fourth width of said fourth base.

5. The bobbin according to claim 1 wherein said winding part comprises a channel, a first lateral plate and a second lateral plate, wherein said channel runs through said first lateral plate and said second lateral plate, and a wire-winding region is defined between said first lateral plate and said second lateral plate, so that said first winding assembly and said second winding assembly are wound around said wire-winding region.

6. The bobbin according to claim 5 wherein said first base, said second base, said third base and said fourth base are integrally formed with said first lateral plate of said winding part.

7. The bobbin according to claim 5 wherein plural wire-arranging notches are formed in said second lateral plate, and extended from the periphery of said second lateral plate.

8. The bobbin according to claim 1 wherein said bobbin further comprises at least one guiding notch.

9. The bobbin according to claim 1 wherein magnetic element further comprises a magnetic core assembly with a first window and a second window, wherein said first extension part of said bobbin is protruded out of said first window, and said second extension part of said bobbin is protruded out of said second window.

10. A magnetic element comprising:

a bobbin comprising a winding part, a first extension part comprising a first base and a second base and a second extension part comprising a third base and a fourth base, wherein said first extension part and said second extension part are separated from each other by said winding part, plural first pins are extended from said first base, plural second pins are extended from said second base, plural third pins are extended from said third base, and plural fourth pins are extended from said fourth base;

a first winding assembly wound around said winding part of said bobbin, and comprising plural first terminals;

a second winding assembly wound around said winding part of said bobbin, and comprising plural second terminals; and a magnetic core assembly for shielding said winding part of said bobbin, said first winding assembly and said second winding assembly, wherein said magnetic core assembly comprises a first window and a second window, said first extension part is protruded out of said first window, said second extension part is protruded out of said second window, and at least one of said first terminals and at least one of said second terminals are simultaneously fixed on at least one of said first extension part and said second extension part, wherein said first terminals of said first winding assembly are placed on said first base of said first extension part and said third base of said second extension part and electrically connected with said first pins and said third pins, respectively, and said second terminals of said second winding assembly are placed on said second base of said first extension part and said fourth base of said second extension part and electrically connected with said second pins and said fourth pins, respectively.

11. The magnetic element according to claim 10 wherein said first base and said second base of said first extension part are separated from each other by a first gap, and said third base and said fourth base of said second extension part are separated from each other by a second gap.

* * * * *